US010377602B2

(12) United States Patent
Adami

(10) Patent No.: US 10,377,602 B2
(45) Date of Patent: Aug. 13, 2019

(54) UP-STACKER FOR FORMING STACKS OF SHEETS AND METHOD

(71) Applicant: Guangdong Fosber Intelligent Equipment Co., Ltd., Foshan (CN)

(72) Inventor: Mauro Adami, Viareggio (IT)

(73) Assignee: Guangdong Fosber Intelligent Equipment Co., Ltd., Foshan, Guangdong Province (CN)

( * ) Notice: Subject to any disclaimer, the term of this patent is extended or adjusted under 35 U.S.C. 154(b) by 0 days.

(21) Appl. No.: 15/927,253

(22) Filed: Mar. 21, 2018

(65) Prior Publication Data

US 2018/0273334 A1 Sep. 27, 2018

(30) Foreign Application Priority Data

Mar. 22, 2017 (EP) ..... 17162274

(51) Int. Cl.
*B65H 33/16* (2006.01)
*B65H 29/50* (2006.01)
(Continued)

(52) U.S. Cl.
CPC ..... *B65H 33/16* (2013.01); *B65H 29/50* (2013.01); *B65H 31/02* (2013.01);
(Continued)

(58) Field of Classification Search
CPC .... B65H 29/50; B65H 31/20; B65H 31/3054; B65H 31/3072; B65H 31/36; B65H 33/16; B65H 33/08
(Continued)

(56) References Cited

U.S. PATENT DOCUMENTS 3,321,202 A 5/1967 Martin
3,992,001 A 11/1976 Martin
(Continued)

FOREIGN PATENT DOCUMENTS

CN 202414847 U 9/2012
CN 203255778 U 10/2013
CN 204057396 U 12/2014

*Primary Examiner* — David H Bollinger
(74) *Attorney, Agent, or Firm* — Breiner & Breiner, L.L.C.

(57) ABSTRACT

The sheet stacker includes a sheet conveyor arrangement, configured for feeding a plurality of sheets and having a sheet discharge end, and a stacking bay. In the stacking bay sheets delivered by the sheet conveyor arrangement are formed into stacks. A stack conveyor is provided in the stacking bay and is movable in a conveyor direction parallel to a sheet feeding direction, according to which the sheets are fed from the sheet discharge end onto the stack conveyor. The sheet discharge end is configured and controlled such that it is gradually lifted during sheet stacking, in order to accommodate a growing stack of sheets being formed on the stack conveyor. A stop plate is positioned in the stacking bay above the stack conveyor and in front of the sheet discharge end of the sheet conveyor arrangement. The stop plate is configured and controlled to be gradually lifted from the stack conveyor as the sheet stack grows, to be withdrawn upon completion of the stack thus allowing removal of the stack in an evacuation direction substantially parallel to the conveyor direction, and to be lowered towards the stack conveyor again.

9 Claims, 8 Drawing Sheets

(51) Int. Cl.

| | |
|---|---|
| ***B65H 31/02*** | (2006.01) |
| ***B65H 31/30*** | (2006.01) |
| ***B65H 33/08*** | (2006.01) |
| ***B65H 31/36*** | (2006.01) |

(52) U.S. Cl.
CPC ..... *B65H 31/3054* (2013.01); *B65H 31/36* (2013.01); *B65H 33/08* (2013.01); *B65H 2301/162* (2013.01); *B65H 2301/4212* (2013.01); *B65H 2301/42194* (2013.01); *B65H 2404/2691* (2013.01); *B65H 2404/721* (2013.01); *B65H 2404/722* (2013.01); *B65H 2404/723* (2013.01); *B65H 2404/725* (2013.01); *B65H 2405/1122* (2013.01); *B65H 2405/1124* (2013.01); *B65H 2701/1762* (2013.01)

(58) Field of Classification Search
USPC ..... 271/200, 201, 213, 224; 414/788.9, 414/789.9, 790.7, 794.6, 791.2
See application file for complete search history.

(56) References Cited

U.S. PATENT DOCUMENTS

| | | | | |
|---|---|---|---|---|
| 4,478,403 | A * | 10/1984 | Byrt ..... | B65H 31/32 271/189 |
| 5,829,951 | A | 11/1998 | Adami | |
| 2009/0169351 | A1 | 7/2009 | Wu | |
| 2014/0353119 | A1 | 12/2014 | Wu | |

* cited by examiner

UP-STACKER FOR FORMING STACKS OF SHEETS AND METHOD

FIELD OF THE INVENTION

The invention relates to sheet stacking devices and methods, useful for the formation of stacks of sheets, such as, but not limited to, corrugated board sheets. In particular, the invention concerns so-called up-stackers, i.e. sheet stacking devices wherein stacks are formed on a stacking surface which remains at a substantially fixed height, while a sheet conveyor arrangement, which delivers the sheets to be stacked has a sheet discharge end which is gradually lifted to accommodate a growing sheet stack.

BACKGROUND OF THE INVENTION

In the paper industry, corrugated board sheets are manufactured starting from a continuous web-like corrugated board material, which is slit longitudinally and divided into strips. Each strip is further divided transversely to generate a plurality of sheets of desired length. Sheets thus obtained are delivered to a so-called stacker or stacking apparatus, which forms stacks or bundles of sheets. The stacks are subsequently delivered to the final user, for example for the manufacturing of corrugated board boxes or the like. Small bundles can be combined into larger stacks before shipping.

Fast advancing sheets must be carefully piled up to form stacks of regular shape. Known stacking apparatuses usually comprise a sheet conveyor arrangement which receives a substantially continuous flow of sheets which are shingled and delivered onto a stacking surface in a stacking bay.

In some cases, each stack is formed by staggered bundles, each bundle containing a predetermined number of sheets. TW-M423688U, US2014/0353119 and US2009/0169351 disclose sheet stackers configured and controlled for forming stacks of mutually staggered bundles of corrugated board sheets. In order to mutually stagger neighboring bundles of the stack, said stack is formed on a horizontally movable stacker platform. The reciprocating staggering motion is in a direction substantially parallel to the feed direction of the corrugated board sheets. The stacker platform comprises a conveyor belt, forming a stacking surface. The conveyor belt has a horizontal conveying motion, orthogonal to the reciprocating staggering motion of the stacker platform. The conveyor belt is used to evacuate the formed stack from the stacking bay according to an evacuation direction which is substantially orthogonal to the direction of arrival of the corrugated board sheets in the stacking bay. Each bundle of a stack is formed against a single stop plate or a dual stop plate, which are arranged in two positions which are staggered along the direction of arrival of the corrugated board sheets. Staggering of neighboring bundles is obtained by means of a reciprocating motion of the stacker platform in a horizontal direction. Moving the entire stacker platform is difficult and requires strong actuators and a particularly sturdy structure.

CN204057396U and CN203255778U disclose further embodiments of stackers designed and configured for producing stacks of sheets, each formed by a plurality of staggered bundles. Staggering is obtained by using two mutually spaced apart stop plates. The distance between the stop plates is equal to the staggering of neighboring bundles. In addition to moving the stop plates, the sheet discharge end of the sheet conveyor must also be reciprocatingly moved back and forth in a direction parallel to the feed direction, to achieve correct staggering of adjacent bundles.

These known methods and devices for the formation of staggered bundles of corrugated board sheets are expensive and cumbersome. There is still a need for improvements in stacking devices and methods capable of forming stacks of mutually staggered bundles.

SUMMARY OF THE INVENTION

According to embodiments disclosed herein, a sheet stacker is provided, which comprises: a sheet conveyor arrangement, configured for feeding a plurality of sheets and having a sheet discharge end; and a stacking bay, wherein sheets delivered by the sheet conveyor arrangement are formed into stacks. The stacking bay comprises a stack conveyor movable in a conveyor direction parallel to a sheet feeding direction, according to which the sheets are fed from the sheet discharge end onto the stack conveyor. The sheet conveyor arrangement is configured and controlled such that the sheet discharge end thereof is gradually lifted during sheet stacking, in order to accommodate a growing stack of sheets being formed on the stack conveyor. Thus, the sheet stacker operates as a so-called up-stacker.

Moreover, in order to orderly arrange the sheets of each stack, a stop plate is positioned in the stacking bay above the stack conveyor and in front of the sheet discharge end of the sheet conveyor arrangement. The stop plate is provided to form an abutment, against which the sheets delivered by the sheet conveyor arrangement onto the stack conveyor are caused to abut and to be stopped. The stop plate is further configured and controlled to be gradually lifted from the stack conveyor as the sheet stack grows. Moreover, the stop plate is configured to be withdrawn upon completion of the stack, to allow removal of the stack in an evacuation direction substantially parallel to the conveyor direction, away from the sheet discharge end of the sheet conveyor arrangement.

Withdrawing the stop plate to allow removal of the stack of just formed sheets means that the stop plate is removed from the path, along which the just formed stack shall be moved during evacuation thereof. Clearing off the stop plate from the stack evacuation path can be obtained e.g. by causing the stop plate to perform an over-travel in the lifting direction, e.g. such that the stop plate moves further upwards at a distance from the stack conveyor, which is greater than the height (vertical dimension) of the stack to be evacuated. Alternatively or in combination with a vertical over-travel, the stop plate can be caused to withdraw from the stack evacuation path by pivoting around an axis, for instance around a horizontal axis.

Thus, a completed stack can be moved away from the sheet conveyor arrangement and, once the stack has been cleared-off the sheet discharge end of the sheet conveyor arrangement, the sheet discharge end can be moved downwards towards the stack conveyor, in order to start formation of a subsequent stack.

According to some embodiments, the sheet stacker is configured and controlled to form stacks of staggered bundles. The bundles are staggered in the conveyor direction. Staggering can be obtained by means of a reciprocating movement of the stack conveyor. The staggering back-and-forth motion of the stack conveyor can be substantially parallel to the evacuation direction.

According to some embodiments, the staggering pitch can be constant. According to other embodiments, the staggering pitch can be adjusted depending upon one or more production parameters of the sheets, for instance depending upon the length of the sheets in the conveyor direction and/or upon the sheet stiffness. In order to facilitate the formation of staggered bundles, the stop plate can have a reciprocating vertical movement and horizontal movement, which are synchronized with the reciprocating staggering motion of the stack according to the stack conveyor direction.

Staggering of the bundles can thus be obtained acting upon the stack conveyor, while a horizontal movement of the sheet conveyor arrangement is not required.

In embodiments disclosed herein, therefore, the stack conveyor is configured and controlled to perform a combined action, namely: to perform a reciprocating staggering motion to form staggered bundles of sheets, and to further perform an evacuation motion, to remove a completed stack from the stacking bay.

Thus, according to embodiments disclosed herein, an evacuation motion of the completed stack is performed in a direction parallel to the reciprocating staggering motion, preferably in a direction concordant with the direction according to which the sheets are delivered onto the stack conveyor.

According to some embodiments, if stacks of staggered bundles are formed, for a smoother operation, the sheet discharge end of the sheet conveyor arrangement can be combined with an actuator, which controls a lifting and lowering movement of the sheet discharge end, which movement is synchronized with the reciprocating staggering motion of the stack conveyor.

The stack conveyor can comprise a single conveyor member, e.g. an endless conveyor member. In other embodiments, the stack conveyor can comprise a first stack conveyor member and a second stack conveyor member, which are sequentially arranged one after the other in the evacuation direction. The first stack conveyor member and the second stack conveyor member can be arranged and controlled such that a stack is formed on the first stack conveyor member and, upon formation thereof, the completed stack is moved by the first stack conveyor member to the second stack conveyor member and sequentially by the second stack conveyor member outside the stacking bay. Once the formed stack has been cleared-off the first stack conveyor member, formation of a new stack can start on the first conveyor member, while the previous stack continues moving in the evacuation direction along the second stack conveyor member. The production rate of the stacking device can thus be improved.

The sheet discharge end can be combined with a bundle retaining device, which is configured and arranged for retaining the top-most bundle of the stack when the stack conveyor performs the staggering motion in a direction away from the sheet discharge end. Undesired displacements of the top-most sheet of a bundle upon starting formation of a subsequent, staggered bundle, are thus reduced or eliminated. The bundle retaining device can comprise at least one resilient sheet braking member, arranged under the sheet discharge end, between the sheet discharge end and the stack being formed on the stack conveyor.

According to a further aspect, the invention also concerns a method of forming sheet stacks on a stacking surface, comprising the following steps:

feeding sheets along a sheet conveyor arrangement towards a stacking bay, the sheet conveyor arrangement having a sheet discharge end, wherefrom the sheets are fed on a stack conveyor in a sheet feeding direction, against a stop plate arranged in the stacking bay, in front of the sheet discharge end and above the stack conveyor;

gradually lifting the sheet discharge end and the stop plate from the stack conveyor to accommodate a growing stack of sheets;

when a stack of sheets is completed, withdrawing the stop plate and moving the stack away from the sheet conveyor arrangement in an evacuation direction substantially parallel to the sheet feeding direction;

moving the sheet discharge end back towards the stack conveyor and lowering the stop plate back towards the stack conveyor;

starting the formation of a next stack of sheets on the stack conveyor.

The method can further comprise the steps of dividing the stack in mutually superposed and staggered bundles of sheets by reciprocatingly moving the stack conveyor according to a back-and-forth, i.e. reciprocating staggering motion, in a direction parallel to the evacuation direction.

The method can further comprise the step of lifting the sheet discharge end from the top of the stack under formation on the stack conveyor when the stack under formation is moved by the stack conveyor towards the sheet discharge end during the back-and-forth staggering motion of the stack conveyor.

When the stack conveyor comprises a first stack conveyor member and a second stack conveyor member sequentially arranged along the direction of motion of the stack conveyor; the method can be such that:

a first stack of sheets is formed on the first stack conveyor member;

upon completion thereof, the first stack of sheets is moved from the first stack conveyor member to the second stack conveyor member in the evacuation direction;

the first stack of sheets is evacuated from the stacking bay by the second stack conveyor member while formation of a second stack starts on the first stack conveyor member.

Other features and advantages of the invention will be better appreciated from the following detailed description of exemplary embodiments.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS OF THE INVENTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
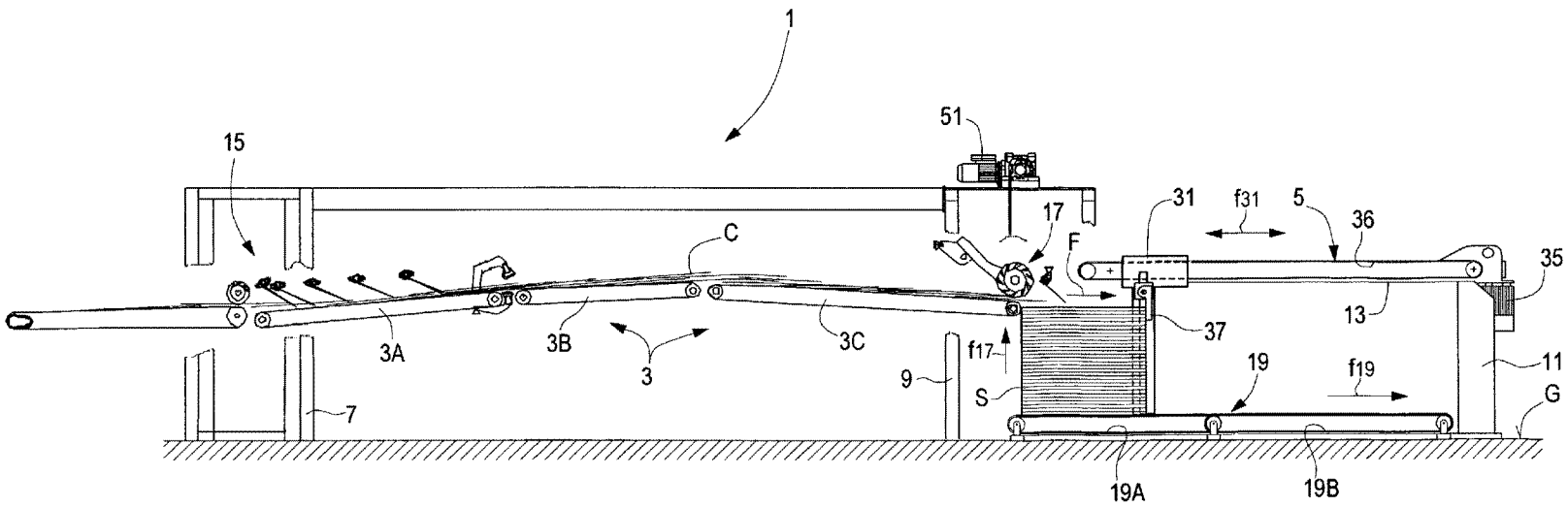
FIG. 1 illustrates a side view of a sheet stacker according to the invention.

Referring now to FIG. 1, a sheet stacker for the formation of stacks of sheets is globally labeled 1. The sheet stacker 1 comprises a sheet conveyor arrangement 3 and a stacking bay 5. According to some embodiments, as shown in FIG. 1, the sheet conveyor arrangement 3 comprises a plurality of sequentially arranged sheet conveyors 3A, 3B, 3C, which define a sheet delivery path. Each sheet conveyor 3A-3C can be comprised of one or more endless flexible members, such as belts or the like, which are entrained around idle and motor-driven rollers to advance corrugated board sheets C or the like, towards the stacking bay 5. The sheet conveyor arrangement 3 can be supported by a stationary supporting structure comprised of uprights 7, 9. The stationary supporting structure can further include uprights 11 and a cross member 13 surrounding the stacking bay 5.

The sheet conveyor arrangement 3 has a sheet inlet side 15 and a sheet discharge end 17. Sheets, e.g. corrugated board sheets coming from a slitter-scorer or other upstream section (not shown) of the manufacturing line, enter the sheet conveyor arrangement 3 at the sheet inlet side 15 and are advanced according to a feeding direction F towards the sheet discharge end 17, where the sheets are discharged in the stacking bay 5 to form stacks S of sheets C as will be described later on.

The stacking bay 5 can comprise a stack conveyor 19. The stack conveyor 19 can be placed in a fixed vertical position, e.g. adjacent a ground level G. The stack conveyor 19 can be comprised of motor-driven rollers, which can be arranged in sequence according to a conveyor direction f19. In other embodiments, the stack conveyor 19 can be comprised of continuous flexible members, e.g. flexible belts or chains. In some embodiments, the stack conveyor 19 comprises a first stack conveyor member 19A and a second stack conveyor member 19B. The first and second stack conveyor members 19A, 19B can be arranged in sequence in the conveyor direction f19. In the exemplary embodiment shown in the drawings, the first stack conveyor member 19A is arranged upstream from the second stack conveyor member 19B in the conveyor direction f19. The first stack conveyor member 19A can be comprised of a plurality of motor-driven roller, or a plurality of co-extensive endless belts or chains, as shown by way of example in the drawings. The second stack conveyor member 19B can be comprised of a plurality of motor-driven rollers, or a plurality of co-extensive endless belts or chains, as again shown in the drawings by way of example. The first and second stack conveyor members 19A, 19B can be controlled one independent of the other. Independently controlled, as used herein may be understood in the sense that the first and second stack conveyor members 19A, 19B can move a stack of sheets placed thereon according to movements which are independent for the two conveyor members. For example, a stack of sheets can be moved from the first stack conveyor member 19A on the second stack conveyor member 19B, and once the stack is on the second conveyor member 19B the first conveyor member 19A can be stopped.

Independently driven motors can e.g. be used to drive the first stack conveyor member 19A and the second stack conveyor member 19B.

In some embodiments, and for the purposes which will be described later on, the stack conveyor 19 can be controlled to move back-and-forth, i.e. with a reciprocating motion, in the conveyor direction f19. In some embodiments, at least one of the stack conveyor members 19A, 19B, preferably the first, i.e. the most upstream stack conveyor member 19A can be controllable with a back-and-forth motion in the conveyor direction f19, while according to some embodiments the second, i.e. the most downstream stack conveyor member 19B can be controlled to move constantly in only one way, rather than reciprocatingly.

In some operating conditions the two stack conveyor members 19A, 19B can be controlled to operate as a single conveyor, for instance when sheets C are processed, which have a dimension in the sheet feeding direction F which is longer than the length of stack conveyor member 19A.

The stack conveyor 19 can be configured to download stacks S on an evacuation conveyor schematically shown at 20. The evacuation conveyor can move the stacks according to a direction parallel to the conveyor direction f19, or according to a direction transverse to the conveyor direction f19, e.g. orthogonal thereto.

The sheets C are fed to the stacking bay 5 according to a sheet feeding direction. Reference F indicates the sheet feeding direction when the sheets C are fed on a stack S under formation on the stack conveyor 19. The direction F is substantially parallel to the stack conveyor direction f19.

It shall be understood that the actual feeding direction F of the sheets upon leaving the sheet conveyor arrangement 3 can be inclined to some extent with respect to the horizontal direction, such that the sheet feeding direction F can have an upwardly or downwardly oriented speed component when the sheets first enter the stacking bay 5. However, the sheets enter the stacking bay 5 according to a direction F which lays in a vertical plane parallel to FIG. 1 and thus parallel to the direction of motion of the stack conveyor 19. The sheets C will be stacked, i.e. piled up on the stack conveyor 19 in a horizontal direction. Thus the feeding direction of the sheets in at least the final portion of the feeding path is generally horizontal and generally parallel to the stack conveyor direction f19.

The sheet conveyor arrangement 3 is configured such that the sheet discharge end 17 thereof is vertically movable in an upwards and downwards direction, as shown by arrow f17. In FIG. 1 the sheet discharge end 17 is moving upwards such as to be gradually lifted from the stack conveyor sheet 19, in order to accommodate a gradually growing sheet stack S. Once a stack S has been completed, as will be described in greater detail later on, the stack S will be removed and the sheet discharge end 17 of the sheet conveyor arrangement 3 will be moved back downwards toward the stack conveyor 19 so that a new stack can be formed.

Along the cross member 13 a carriage 31 can be slidingly mounted. The carriage 31 can move along the cross member 13 according to double arrow f31 under the control of a motor 35, e.g. through a rack-and-pinion transmission system, a belt 36 (as schematically shown e.g. in FIGS. 2A-2E) or the like. The carriage 31 supports a stop plate 37 which can extend in a general vertical direction. The stop plate 37 can move vertically up and down according to double arrow f37 (FIGS. 2A-2E) under the control of a suitable actuator, such as a cylinder-piston actuator, an electric or hydraulic motor, or the like. An exemplary electric motor is shown at 44.

Referring now to FIGS. 2A-2E, with continuing reference to FIG. 1, according to some embodiments, the sheet discharge end 17 of the sheet conveyor arrangement 3 can comprise, in a manner known to those skilled in the art, a bottom roller 41 and a top roller 45, which define in combination a sheet discharge nip 43, where through the sheets C conveyed by the sheet conveyor arrangement 3 are discharged in the stacking bay 5. The bottom roller 41 can be a motor-driven roller which controls the movement of the most downstream conveyor 3C of the sheet conveyor arrangement 3.

The vertical motion according to double arrow f17 of the sheet discharge end 17 can be controlled by a linear actuator, such as a cylinder-piston actuator, by an electric motor 51 or the like.

The operation of the sheet stacker 1 described so far will now be described with reference to the sequence of FIGS. 2A-2E.

During stacking, the stop plate 37 is located at a distance from the sheet discharge end 17 of the sheet conveyor arrangement 3, which is determined by the dimension of the corrugated board sheets C in the direction F. In this way, each corrugated board sheet C delivered into the stacking bay 5 will advance until reaching the stop plate 37, and all the sheets C will thus abut against the stop plate 37 and be aligned with their most advanced edges (leading edges) abutting against the stop plate 37.

The height (vertical dimension) of the stack S increases (FIGS. 2A-2B) with the number of sheets C stacked on the stack conveyor 19. To accommodate the gradually growing stack, the sheet discharge end 17 of the sheet conveyor arrangement 3 is gradually lifted according to arrow f17, such that the sheet discharge nip 43 is constantly maintained in the correct position with respect to the top of the stack S being formed.

According to embodiments disclosed herein, also the stop plate 37 is gradually moved upwards and distanced from the stack conveyor 19, according to arrow f37 while the vertical dimension of the stack S increases. For instance the stop plate 37 can be supported by a slide 38, which can be moved along vertically extending guides 40. The guides 40 may be mounted on vertical beams 42, which may in turn project downwardly from the carriage 31. The motor 44 is provided to move the slide 38 upwards and downwards as disclosed herein.

Figure 2A:
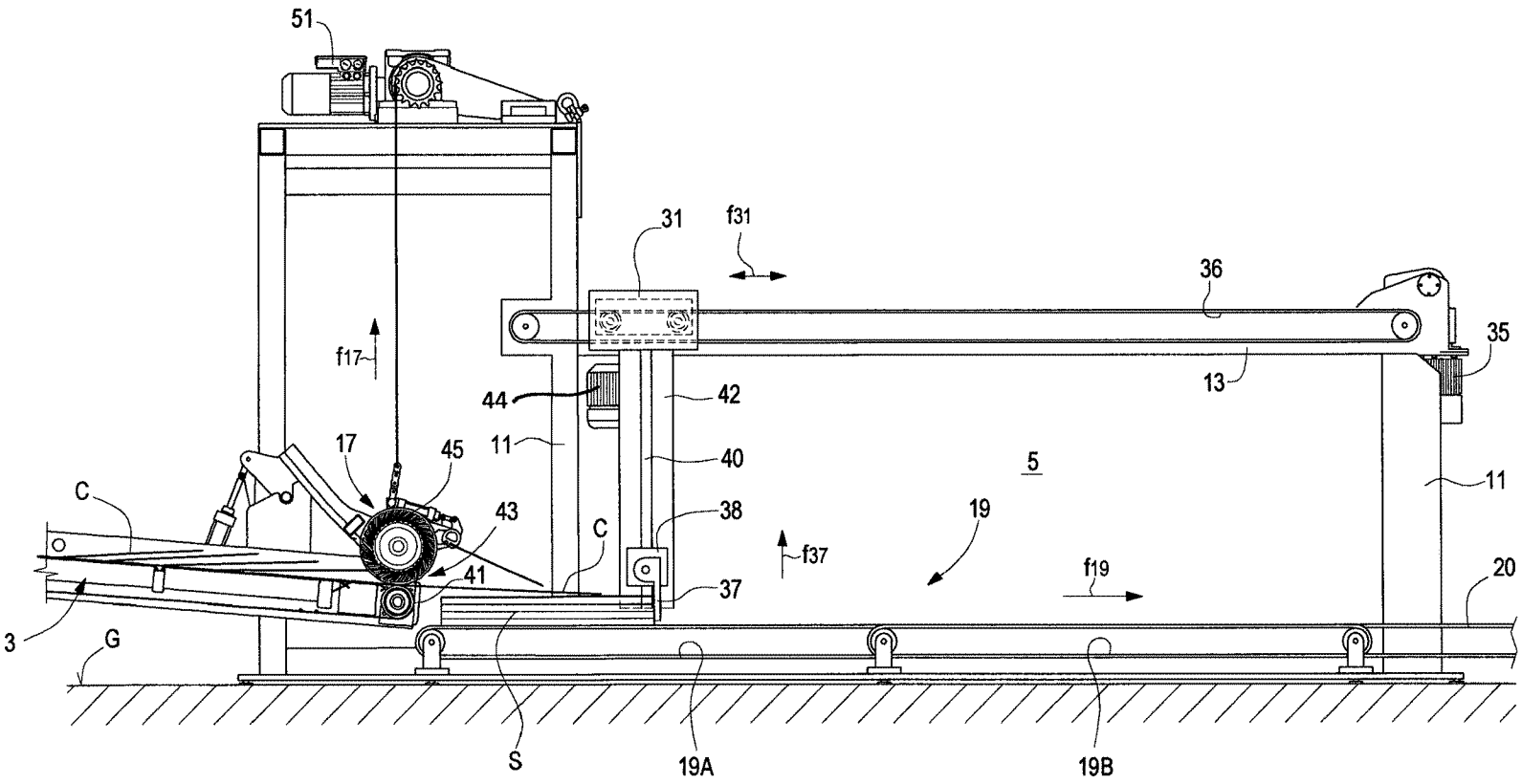
FIGS. 2A-2E illustrate sequence of steps of a stack-forming cycle.
Figure 2B:
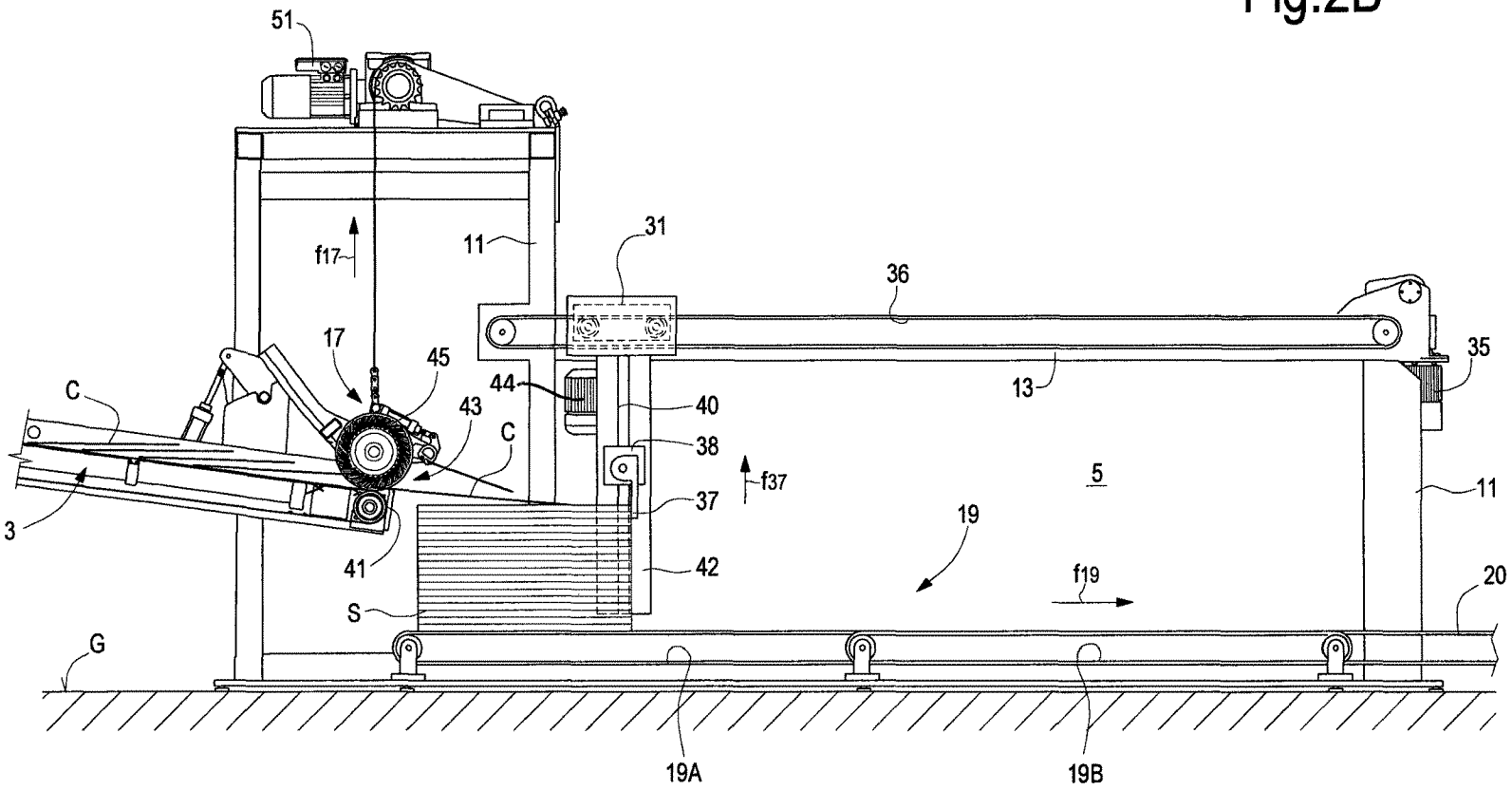
Figure 2C:
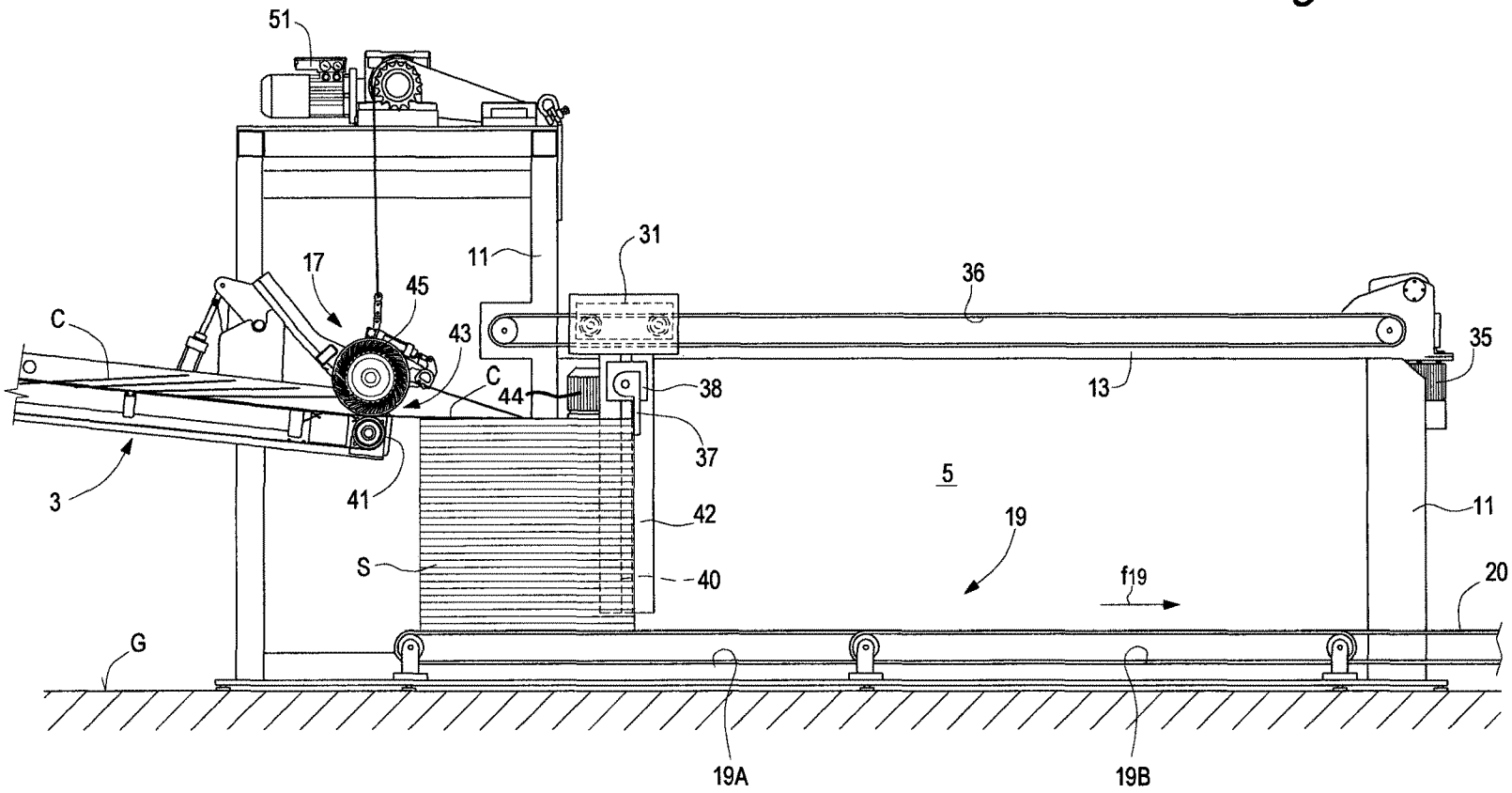

In FIG. 2C the stack S has been completed. While in the exemplary embodiment of FIG. 2C the stack S has just the maximum vertical dimension allowed by the stacking bay, it shall be understood that the height of the finished stack S may be smaller than shown in FIG. 2C. For instance, if smaller jobs are required, with a reduced number of sheets C in each stack, the stacks S may have a limited vertical dimension.

In a manner known per se, a gap is formed in the flow of sheets C traveling along the sheet conveyor arrangement 3, such that for a certain period of time as required to clear off the stack S, no further sheets C are delivered at the sheet discharge end 17 of the sheet conveyor arrangement 3. This time interval is sufficient to perform evacuation of the stack as described here below referring to FIGS. 2C-2E.

Figure 2D:
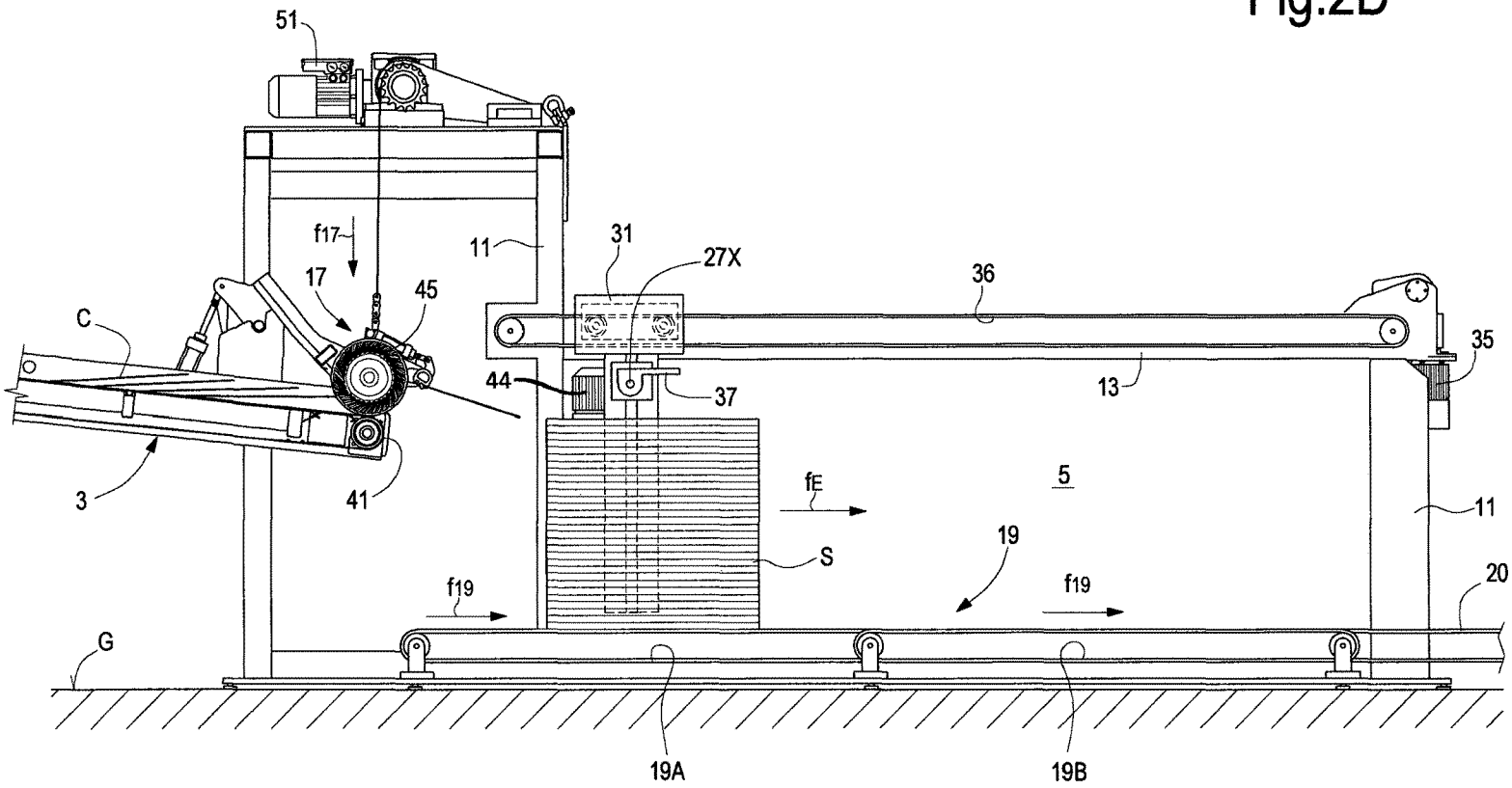

In order to remove the just formed stack S from the stacking bay 5, the stop plate 37 is cleared off the evacuation path, i.e. the path along which the stack S must be moved by the stack conveyor 19. In FIG. 2D the stop plate 37 has been withdrawn from the path by pivoting the stop plate 37 around a horizontal axis 27X. In other embodiments, the stop plate 37 may be moved farther upwards (by an over-travel of the slide 38) so that the bottom edge thereof moves above the top-most sheet of the stack S. A combination of an over-travel and a pivoting movement can be also envisaged.

Figure 2E:
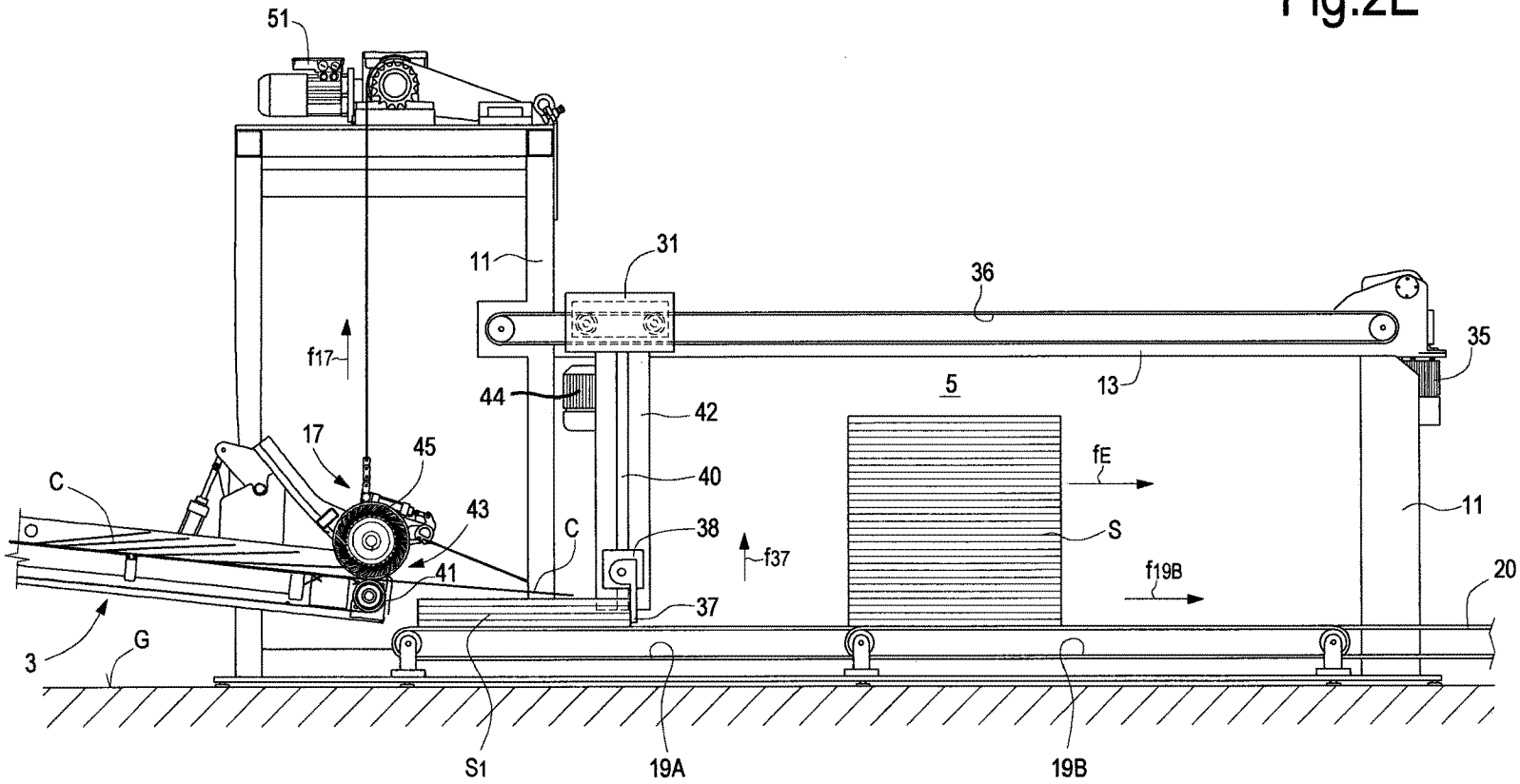

Once the stop plate 37 has been cleared off the stack evacuation path, the stack S can start moving in an evacuation direction fE (FIG. 2D), parallel to the conveyor direction f19. The motion is imparted to the stack S by the stack conveyor 19. Once the trailing edge of the stack S has been moved away from the sheet discharge end 17 of the sheet conveyor arrangement 3, this latter can start moving downwards to position the sheet discharge end 17 adjacent the stack conveyor 19 again, such that formation of a new stack S can start. Also the stop plate 37 can be moved downwards towards the stack conveyor 19, once the just formed stack S has moved past the stop plate 37, as shown in FIG. 2E. The evacuation motion according to the evacuation direction fE of the just formed stack S towards the evacuation conveyor 20 can continue, while the formation of a new stack S1 can start. This is possible e.g. by providing two stack conveyor members 19A, 19B arranged in series along the evacuation direction fE. Indeed, once the previously formed stack S has been removed from the first stack conveyor member 19A and has been transferred onto the second stack conveyor member 19B, the first conveyor member 19A can be stopped, such that formation of the next stack S1 can start. The second conveyor member 19B continues traveling according to arrow fE until the stack S has been transferred on the evacuation conveyor 20. In other embodiments, the stack S can be removed from the second conveyor member 19B, e.g. by means of a shuttle, a forklift or the like.

Figure 3A:
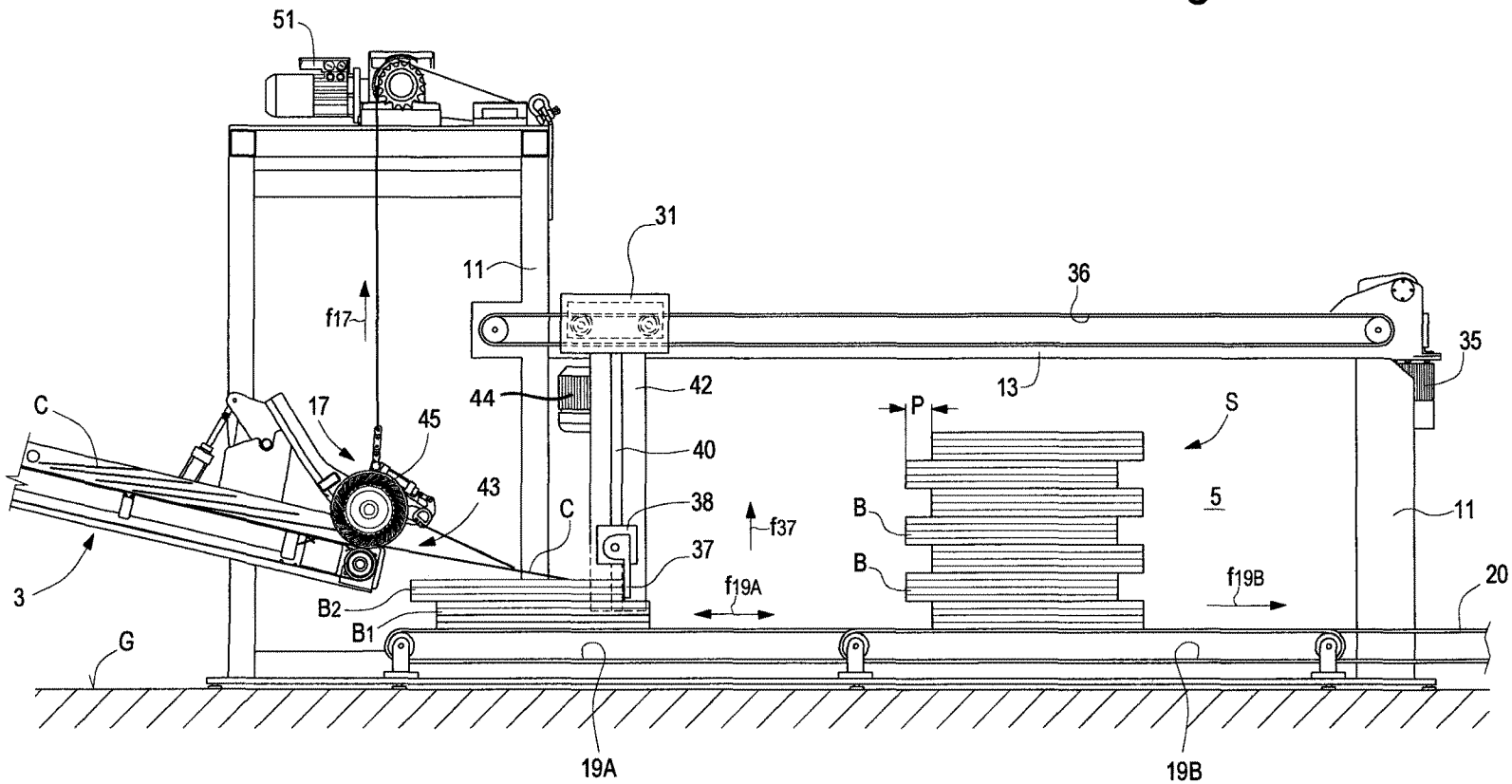
FIGS. 3A-3B illustrate sequence of steps of a stack-forming cycle according to a different mode of operation of the stacker of FIG. 1.
Figure 3B:
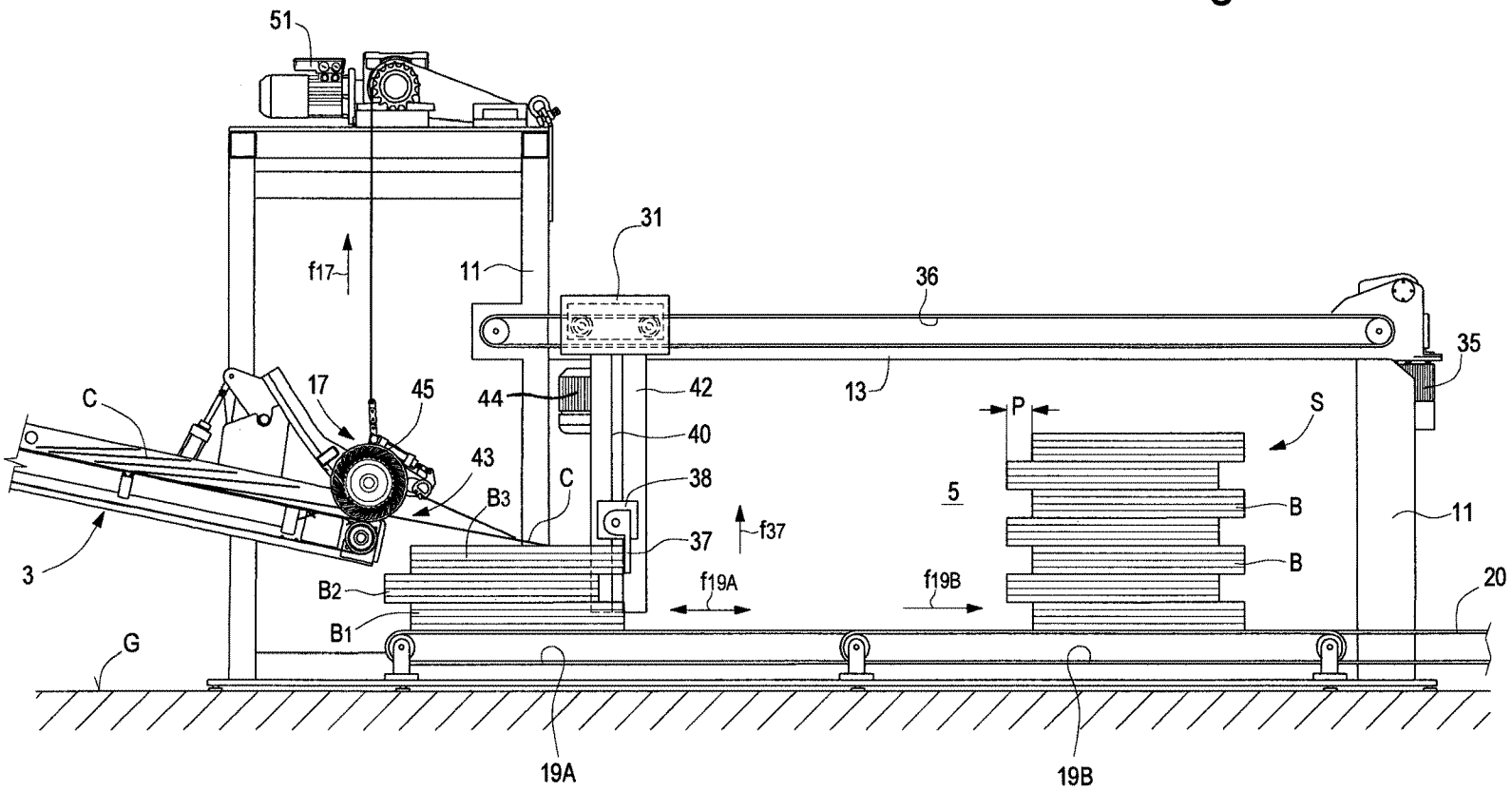

The same sheet stacker 1 described so far can be used to produce stacks S of staggered bundles B of sheets, as shown in FIGS. 3A, 3B, wherein the same reference numbers indicate the same or equivalent parts, components or elements as in FIGS. 1-2E, which will not be described again.

Each stack S is formed of a plurality of bundles B. Each bundle B contains a certain number of corrugated board sheets C. The number of sheets of each bundle B of a stack S can be constant. The bundles B are mutually staggered by a pitch P in the direction F, i.e. the sheet feeding direction on the stack conveyor 19, that is in turn parallel to the stack evacuation direction fE and to the conveyor direction f19. Staggering of mutually superposed bundles B is obtained by means of a back-and-forth, i.e. a reciprocating staggering motion of the stack conveyor 19 according to double arrow f19. The sheet discharge end 17 can move in a vertical direction, but does not require to move horizontally.

During stacking, the stop plate 37 is located at a distance from the sheet discharge end 17 of the sheet conveyor arrangement 3, which is determined by the dimension (length) of the corrugated board sheets C in the direction F. In this way, each corrugated board sheet C delivered into the stacking bay 5 will advance until reaching the stop plate 37, and all the sheets C will thus be aligned with their most advanced edges (leading edges) abutting against the stop plate 37.

In order to stagger the bundles B in the direction f19, once the desired number of corrugated board sheets C forming a bundle B has been piled up, the stack conveyor 19 moves by a pitch P towards the sheet conveyor arrangement 3 and away therefrom, alternatively. Starting from FIG. 3A, once the top-most bundle, labeled B3 has been completed, the stack S under formation is moved towards the left, i.e. towards the sheet discharge end 17, such that the stack S moves slightly underneath the sheet discharge end 17 of the sheet conveyor arrangement 3. To this end, the sheet discharge end 17 can be temporarily lifted and then lowered again, to start the formation of the next bundle B4. FIG. 3B shows the stack S in the new position, after the staggering movement has been performed and the subsequent bundle B4 is almost completed. The stop plate 37 can remain in the same horizontal position, and can continue to be lifted gradually as the next bundle grows vertically.

In order to allow the trailing edges of the sheets (i.e. the most upstream edges of the cardboard sheets C with respect to the direction of feed F) of the last formed bundle B to move under the sheet discharge end 17, this latter is temporarily lifted when the stack S moves to the left. Bundle retention means (not shown) can be arranged at the sheet discharge end 17 of the sheet conveyor arrangement 3, to prevent undesired misplacement of the sheets C when the stack S is moved back-and-forth to form the staggered bundles B1, B2, B3, . . . .

The stop plate 37 can remain stationary during formation of each bundle or may be gradually lifted, depending e.g. upon the height (vertical dimension) of each bundle B.

When the bundle B4 has been completed, the stack conveyor member 19A moves the stack back in the position of FIG. 3A by pitch P and a new bundle can be formed. The stop plate 37 can be lifted and lowered again such that it will rest on the top bundle B4.

Once the desired number of bundles B has been formed on the stack S, this latter is evacuated as described above, by moving the first stack conveyor member 19A and the second stack conveyor member 19B, until the stack has cleared off the first stack conveyor member 19A. The stop plate 37 is temporarily removed from the stack evacuation path.

Once the first stack has been removed from conveyor member 19A, this latter can accommodate the next stack and can be controlled to move back-and-forth, i.e. reciprocatingly, according to arrow f19 in order to stagger bundles B1, B2, B3 . . . of the next stack, while the previously formed stack S can be moved farther by the second stack conveyor member 19B towards the evacuation conveyor 20 or any other suitable removal means.

In some embodiments, the stack conveyor 19 may include a single section or stack conveyor member. In such case formation of a next stack cannot start until the previous stack S has been moved towards a pick-up position, wherefrom it can be picked up without further motion of the stack conveyor 19. This may require more time before formation of the next stack can start. Nevertheless, re-positioning of the stop plate 37 and of the sheet discharge end 17 can be made while the formed stack continues moving towards the pick-up area, e.g. the evacuation conveyor 20.

The above described sheet stacker structure can be used also to produce stacks of sheet bundles which are different one from the other, e.g. which can be formed of sheets having differing length in the sheet feeding direction F. A group of identical sheets can form a job. Different jobs, formed of sheets of different dimensions, can thus be placed one on top of the other in the same stack S. The reciprocating movement of the stack conveyor 19 in the conveyor direction f19 allows the various bundles to be centered one with respect to the other, such that when a shorter bundle and a longer bundle are placed in sequence, in the same stack S, the longer bundle (i.e. the bundle formed by sheets having a longer dimension in the sheet feeding direction F) projects from the bundle formed by sheets having a shorter dimension both upstream and downstream thereof. The reciprocating movement of the stack conveyor 19 thus allows sheets of different dimensions to be stacked in an optimal way. In preferred embodiments, the bundles of different jobs are stacked in a symmetrical way, such that each bundle is centered (in the sheet feeding direction) with respect to the adjacent bundles.

While the invention has been described in connection with what is presently considered to be the most practical and preferred examples, it is to be understood that the invention is not to be limited to the disclosed examples, but on the contrary, is intended to cove various modifications and equivalent arrangements included within the spirit and scope of the appended claims.

The invention claimed is:

1. A sheet stacker, comprising:

a sheet conveyor arrangement, configured for feeding a plurality of sheets and having a sheet discharge end;

a stacking bay, wherein sheets delivered by the sheet conveyor arrangement are formed into stacks and is comprised of a stack conveyor movable in a conveyor direction parallel to a sheet feeding direction, according to which the sheets are fed from the sheet discharge end onto the stack conveyor;

wherein the sheet discharge end is configured to be gradually lifted during sheet stacking, in order to accommodate a growing stack of sheets being formed on the stack conveyor; wherein a stop plate is supported by a slide positioned on a vertically extending guide in the stacking bay above the stack conveyor and in front of the sheet discharge end of the sheet conveyor arrangement; and wherein the stop plate is configured to be gradually lifted along said guide from the stack conveyor as the sheet stack grows, and to be withdrawn upon completion of the stack, thus allowing removal of the stack in an evacuation direction substantially parallel to the conveyor direction, away from the sheet discharge end of the sheet conveyor arrangement, and to be lowered towards the stack conveyor again.

2. The sheet stacker of claim 1, wherein the stack conveyor is configured to provide a reciprocating staggering movement during formation of a stack.

3. The sheet stacker of claim 2, wherein the stop plate is configured to move reciprocatingly in a vertical direction and a horizontal direction, movement in the vertical direction and the horizontal direction of the stop plate being synchronized with the reciprocating staggering movement of the stack conveyor.

4. The sheet stacker according to claim 1, wherein the stack conveyor comprises a first stack conveyor member and a second stack conveyor member, which are sequentially arranged one after another in the evacuation direction.

5. The sheet stacker of claim 4, wherein the first stack conveyor member and the second stack conveyor member are constructed and arranged such that a stack is formed on the first stack conveyor member and, upon formation thereof, a completed stack is moved by the first stack conveyor member to the second stack conveyor member and sequentially by the second stack conveyor member outside the stacking bay.

6. A method of forming stacks of sheets on a stack conveyor, comprising steps as follows:

feeding sheets along a sheet conveyor arrangement towards a stacking bay, the sheet conveyor arrangement having a sheet discharge end, wherefrom the sheets are fed on a stack conveyor in a sheet feeding direction, against a stop plate arranged in the stacking bay, in front of the sheet discharge end and above the stack conveyor;

gradually lifting the sheet discharge end and the stop plate from the stack conveyor to accommodate a growing stack of sheets, wherein the stop plate is positioned on a slide and said gradual lifting is along a vertically extending guide;

when a stack of sheets is completed, withdrawing the stop plate and moving the stack away from the sheet conveyor arrangement in an evacuation direction substantially parallel to the sheet feeding direction;

moving the sheet discharge end back towards the stack conveyor and lowering the stop plate back towards the stack conveyor;

starting the formation of a next stack of sheets on the stack conveyor.

7. The method of claim 6, further comprising dividing the stack in mutually superposed and staggered bundles of sheets by reciprocatingly moving the stack conveyor according to a back-and-forth staggering motion, in a direction parallel to the evacuation direction.

8. The method of claim 7, further comprising lifting the sheet discharge end from a top of the stack under formation on the stack conveyor when the stack under formation is moved by the stack conveyor towards the sheet discharge end during back-and-forth staggering motion of the stack conveyor.

9. The method of claim 6, wherein the stack conveyor comprises a first stack conveyor member and a second stack conveyor member sequentially arranged along a conveyor direction substantially parallel to the sheet feeding direction; the method further comprising steps as follows:

forming a first stack of sheets on the first stack conveyor member;

upon completion of the first stack of sheets, moving the first stack of sheets from the first stack conveyor member to the second stack conveyor member in the evacuation direction;

evacuating the first stack from the stacking bay while formation of a second stack starts on the first stack conveyor member.

* * * * *